US009539718B2

(12) United States Patent
Hall

(10) Patent No.: US 9,539,718 B2
(45) Date of Patent: Jan. 10, 2017

(54) ERGONOMIC HANDLE FOR A FLUID APPLICATOR SPRAY GUN

(71) Applicant: Jeffery Hall, Warren, MI (US)

(72) Inventor: Jeffery Hall, Warren, MI (US)

( * ) Notice: Subject to any disclaimer, the term of this patent is extended or adjusted under 35 U.S.C. 154(b) by 0 days.

(21) Appl. No.: 14/577,630

(22) Filed: Dec. 19, 2014

(65) Prior Publication Data

US 2015/0129685 A1 May 14, 2015

(51) Int. Cl.

*B25G 1/00* (2006.01)
*B25G 1/10* (2006.01)
*B05B 7/24* (2006.01)

(52) U.S. Cl.

CPC ..... *B25G 1/00* (2013.01); *B05B 7/2478* (2013.01); *B25G 1/102* (2013.01); *Y10T 16/476* (2015.01)

(58) Field of Classification Search

CPC .... B05B 15/061; Y10T 16/476; Y10T 16/466; Y10T 16/469; Y10T 16/4713; Y10T 16/19; Y10T 16/12; B25G 1/102
USPC ..... 239/525–530; 16/430, 422
See application file for complete search history.

(56) References Cited

U.S. PATENT DOCUMENTS 1,503,251 A * 7/1924 Schoof ..... A01O 5/02 111/99
2,951,482 A * 9/1960 Sullivan ..... A61B 17/14 16/430
D230,960 S * 3/1974 Peroni ..... D12/317
3,879,048 A * 4/1975 Penney ..... A63C 11/222 280/821
4,004,818 A * 1/1977 Ramillon ..... A63C 11/222 280/821
4,269,359 A * 5/1981 Neiss ..... B24C 5/02 239/530
D285,749 S 9/1986 Mariol
4,885,818 A * 12/1989 Arterbury ..... A22B 3/10 16/430
5,236,129 A * 8/1993 Grime ..... B05B 7/0081 239/289
5,330,108 A 7/1994 Grime et al.
5,332,156 A * 7/1994 Wheeler ..... B05B 15/00 173/170
5,395,046 A 3/1995 Knobbe et al.
(Continued)

*Primary Examiner* — Arthur O Hall
*Assistant Examiner* — Joseph A Greenlund
(74) *Attorney, Agent, or Firm* — Wayne State Univ. Law School Patent Clinic; David C. Berry

(57) ABSTRACT

An ergonomic handle assembly can allow an operator to comfortably support weight of a fluid filled reservoir connected to a fluid applicator sprayer. Any combination of first, second and third shoulders can be formed on the handle assembly to provide increased support surface area in three dimensions with respect to a hand of an operator supporting the fluid applicator spray gun for distributing weight across both the palm and fingers through a proximal support surface of the first support shoulder, the distal support surface of the second support shoulder, and the proximal support surface of the third support shoulder. The increased support surface area can allow an operator to support and handle the fluid applicator spray gun with reduced gripping force when compared to existing fluid applicator spray guns. The reduced gripping force can reduce the likelihood of repetitive stress syndrome injuries to the hand and arm of an operator.

16 Claims, 9 Drawing Sheets

(56) References Cited

U.S. PATENT DOCUMENTS

| | | | | | |
|---|---|---|---|---|---|
| 5,761,767 | A * | 6/1998 | Barton | A45C 13/26 | 16/430 |
| 6,019,294 | A * | 2/2000 | Anderson | B05B 7/0081 | 239/302 |
| 6,419,601 | B1 * | 7/2002 | Kenner | A63B 49/08 | 16/430 |
| 6,581,247 | B1 * | 6/2003 | Yu Chen | B65H 35/0033 | 16/430 |
| 6,721,997 | B2 * | 4/2004 | Hua | B25G 1/10 | 16/421 |
| 7,284,300 | B1 * | 10/2007 | Bruns | B25G 1/102 | 16/110.1 |
| 7,588,158 | B2 * | 9/2009 | Burstein | B67C 11/02 | 16/430 |
| 7,721,977 | B2 | 5/2010 | Kohs et al. | | |
| 7,866,473 | B2 * | 1/2011 | Clark, Jr. | B65D 75/5833 | 206/440 |
| D661,964 | S * | 6/2012 | Pangborn | D8/107 | |
| 8,402,610 | B2 * | 3/2013 | Boes | A47J 45/071 | 16/110.1 |
| 2003/0042333 | A1 * | 3/2003 | Wiersma | B05B 15/061 | 239/525 |
| 2003/0205627 | A1 * | 11/2003 | Wu | B05B 1/3026 | 239/526 |
| 2006/0174448 | A1 * | 8/2006 | You | B43K 23/008 | 16/430 |
| 2007/0240284 | A1 * | 10/2007 | Blauer | A45B 9/02 | 16/430 |
| 2007/0251059 | A1 * | 11/2007 | You | A45B 9/02 | 16/430 |
| 2008/0148523 | A1 * | 6/2008 | MacGregor | G06K 7/10881 | 16/430 |
| 2013/0061725 | A1 * | 3/2013 | Freuler | B25G 1/102 | 81/489 |

* cited by examiner

C

ERGONOMIC HANDLE FOR A FLUID APPLICATOR SPRAY GUN

FIELD OF THE INVENTION

The invention relates generally to a handle for spray guns for applying fluids, by way of example and not limitation, such as paints, and more particularly concerns a handle providing ergonomic characteristics to reduce the user stress and fatigue from supporting the weight of the spray gun.

BACKGROUND

When loaded with a fluid to be supplied, by way of example and not limitation, such as paint, a spray gun is heavy and can be difficult to properly maneuver when applying fluid onto surfaces to be coated. Known spray gun handles do not contain ergonomic features that allow the user to support the weight of the sprayer through multiple contact and support points. The lack of this feature can cause excessive tension and stress on the hand and arm of the operator of the spray gun. Repetitive stress is thus placed on specific areas of the operators hand and arm because the grip design of the spray gun does not adequately allow for the operator to balance the weight of the fluid reservoir when moving the sprayer around. Examples of various configurations of known spray gun handles can be seen in U.S. Pat. Nos. 5,236,129; 5,332,156; U.S. Pat. Nos. D661,964; D285,749; U.S. Pat. No. 5,395,046; U.S. Published Application No. 2003/0042333. While each of these examples appears suitable for its intended purpose as a fluid applicator sprayer, the configurations disclosed do not contain the features that allow for better control and reduced stress and fatigue on the operator. The problem with traditional fluid applicator sprayer handles is that the top heavy fluid reservoir can become unwieldy to the operator and cause discomfort for the operator when used for extended periods of time.

SUMMARY

The present invention is directed to a device that satisfies the need of the fluid applicator sprayer operator to have a handle that ergonomically conforms to the hand of the operator to reduce stress and strain placed on the operator with a standard handle assembly. When using the fluid applicator sprayer the operator can reduce the stress and strain placed on the arm and hand by having additional, strategically placed points of contact to help better support the sprayer. In each configuration of the present invention, the placement of these points of contact is outlined to provide support to differing portions of the hand of an operator. The placement of each of the supports corresponds with the differing types of stress and fatigue that the operator can encounter while using the fluid applicator sprayer.

In one configuration, the sprayer handle extends from the fluid applicator sprayer to form an elongated body portion with a convex shape form. The body can have a proximal and distal end with the proximal end connecting to the sprayer. The convex outer portion of the elongated body is shaped in a manner to conform to the hand of an operator. This ergonomic shape allows the operator to comfortably grip the handle and distribute the weight evenly across the entire hand and reduce the stress placed on the hand with traditional shaped handles. This type of fluid applicator sprayer handle can be installed onto the fluid applicator sprayer at the time of production, or can be provided as an after market product to attach over a convention fluid applicator sprayer handle.

A fluid applicator sprayer handle can include a first support shoulder extending laterally from the elongated body. The first support shoulder can have a first proximal surface and a first distal surface. The first support shoulder can be located spaced from the proximal end of the elongated body. The first proximal surface can be shaped in a manner to support a thumb of an operator, in either a right hand or left hand version, to grip the handle, and can reduce the potential for tipping of the fluid reservoir either toward or away from the operator. This reduction in potential for tipping of the fluid reservoir can reduce the tension and fatigue placed on the operator when using the fluid applicator sprayer.

The fluid applicator sprayer handle can include a second support shoulder extending laterally from the elongated body opposite the first support shoulder. The second support shoulder can have a second proximal surface and a second distal surface and can be located closer to the proximal end of the elongated body than the first support shoulder. The second distal surface of the second support shoulder can be shaped in a manner to be supported by an index finger of an operator, in either a right hand or left hand version of the handle. The second support shoulder can reduce the potential for tipping of the fluid reservoir either toward or away from the operator and make the sprayer more comfortable to use.

The fluid applicator sprayer handle can include a third support shoulder extending laterally from the elongated body. The third support shoulder can have a third proximal surface and a third distal surface and can be located closer to the distal end of the elongated body. The third support shoulder can be located on the same side as the second support shoulder. The third proximal surface of the third support shoulder can be shaped in a manner to be in supporting contact with a pinky finger of the operator, in either a right hand or left hand version of the handle. The third support shoulder can reduce the potential for tipping of the reservoir either toward or away from the operator and make the sprayer more comfortable to use.

The fluid applicator sprayer handle can include a set of channels located on the elongated body for accommodating individual fingers of the operator in a pistol grip fashion. These channels can allow for the operator to grip the handle in a more secure and comfortable manner.

The fluid applicator sprayer handle can be manufactured to allow the handle to be attachable and removable from an existing sprayer handle by being formed with an interior surface conforming to an external surface of an existing handle of a fluid applicator sprayer. The sprayer handle can include an internal aperture extending from the proximal end to the distal end allowing for the handle to be overlaid in a manner sheathing at least a portion of the exterior surface of the existing handle of a fluid applicator sprayer.

The fluid applicator sprayer handle can be removable in nature by being formed in a manner that conforms to the existing handle of a fluid applicator sprayer. The handle assembly would have a base portion at the proximal end with two longitudinally extending side portions. The two longitudinally extending side portions would form the convex external gripping section for the operator. The two longitudinally extending side portions would also form an internal aperture that would be placed around the outside of the existing sprayer handle. The base portion would have a port for an air hose to connect to the fluid applicator sprayer.

A fluid applicator sprayer handle can be split into two opposite halves that can then be connected around an existing fluid applicator sprayer handle via a fastener. This embodiment will allow for the sprayer handle to be retrofitted onto an existing fluid applicator sprayer that does not contain ergonomic features. By way of example and not limitation, a fluid applicator sprayer handle can be made from a hard molded polymer or from a hard metal.

The ergonomic handle assembly can be incorporated into spray guns with a top loading reservoir along with other known reservoir configurations. Other applications of the present invention will become apparent to those skilled in the art when the following description of one mode contemplated for practicing the invention is read in conjunction with the accompanying drawings.

BRIEF DESCRIPTION OF THE DRAWINGS

The description herein makes reference to the accompanying drawings wherein like reference numerals refer to like parts throughout the several views, and wherein.

DETAILED DESCRIPTION

The following description is of one presently contemplated mode of carrying out the invention of an ergonomic handle assembly for use on a spray gun. The handle assembly of the present invention can be configured for right or left hand use and multiple varieties of spray guns with various fluid reservoirs. It should be noted that the attached illustrations are for a right hand version of the ergonomic handle. It should be recognized by those skilled in the art that a left hand version of the ergonomic handle would be a mirror image of the attached illustrations. It should be recognized by those skilled in the art that a fluid applicator spray gun can be used for a wide variety of fluid material applications. By way of example and not limitation, materials applied by a fluid applicator spay gun can include paint, powder, fiber glass, resin, gel coat, adhesives, sealers, fillers, foam, insulation, coatings for protection against oxidation or scratches, solvents, cleaning solutions, and any combination thereof.

Figure 1:
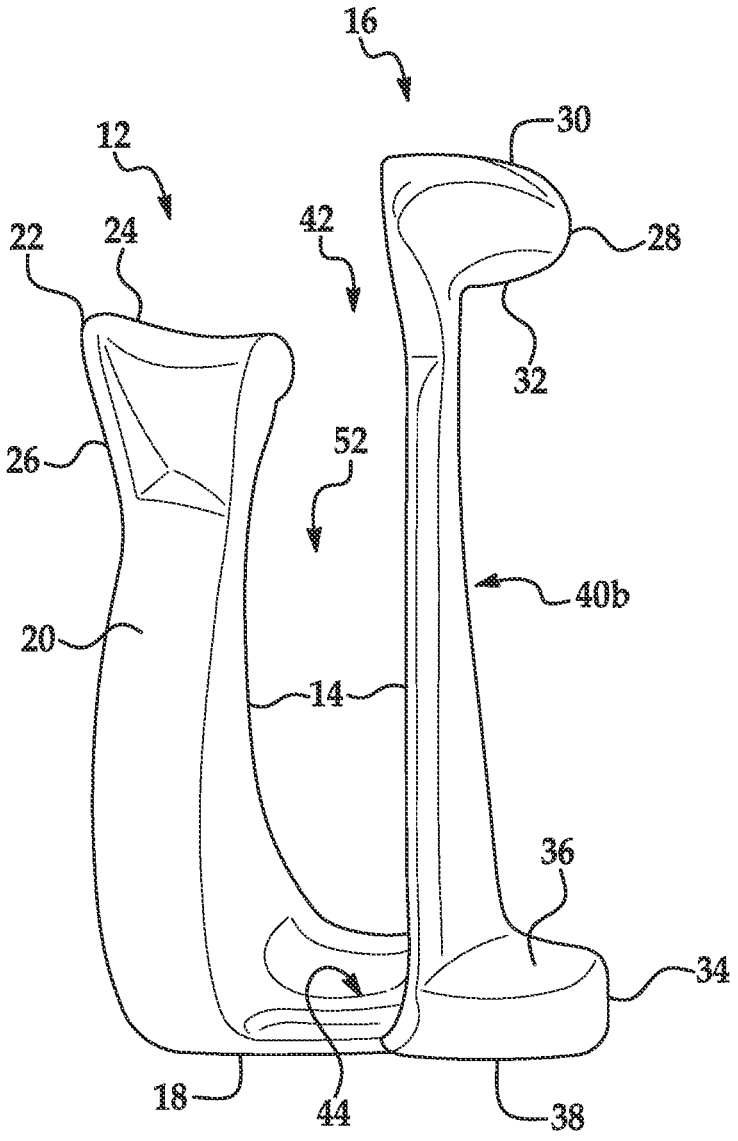
FIG. 1 is a perspective view of an elevation of an ergonomic handle assembly.
Figure 2:
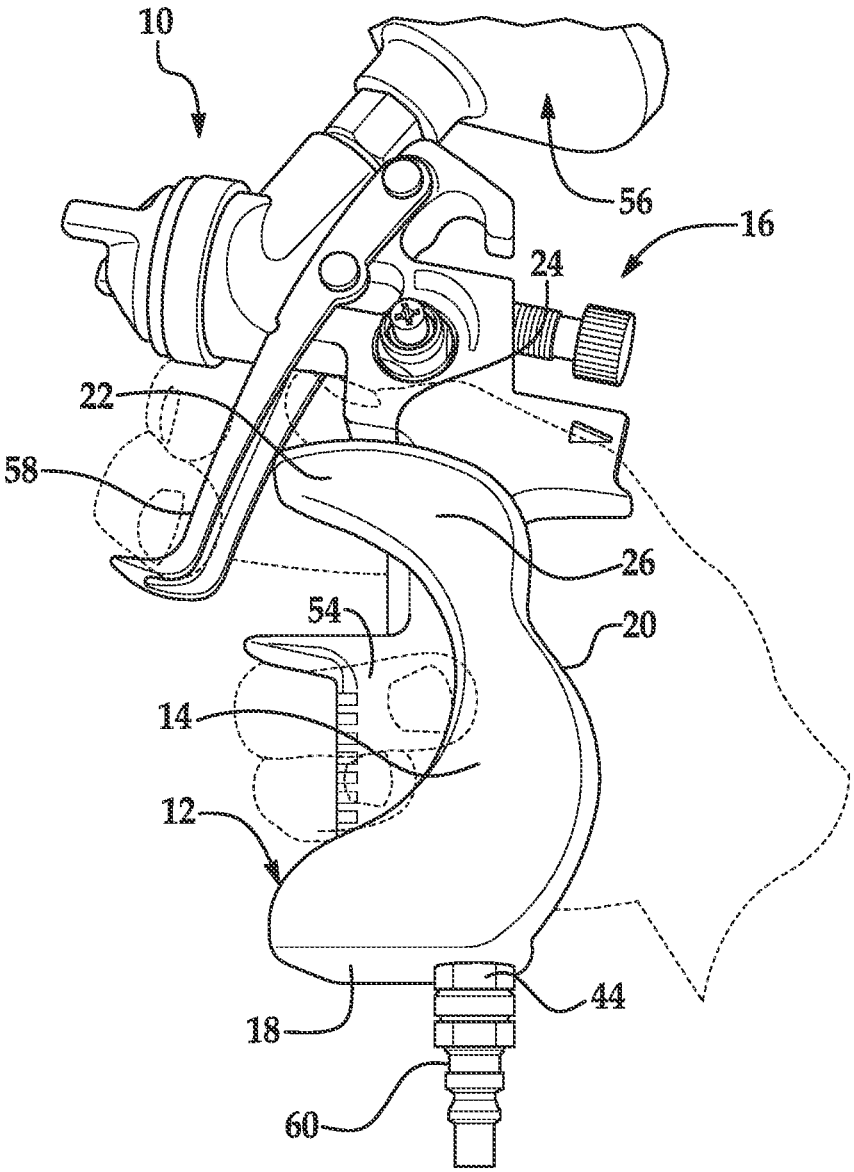
FIG. 2 is a side elevational view of a first side of the ergonomic handle assembly of FIG. 1.
Figure 4:
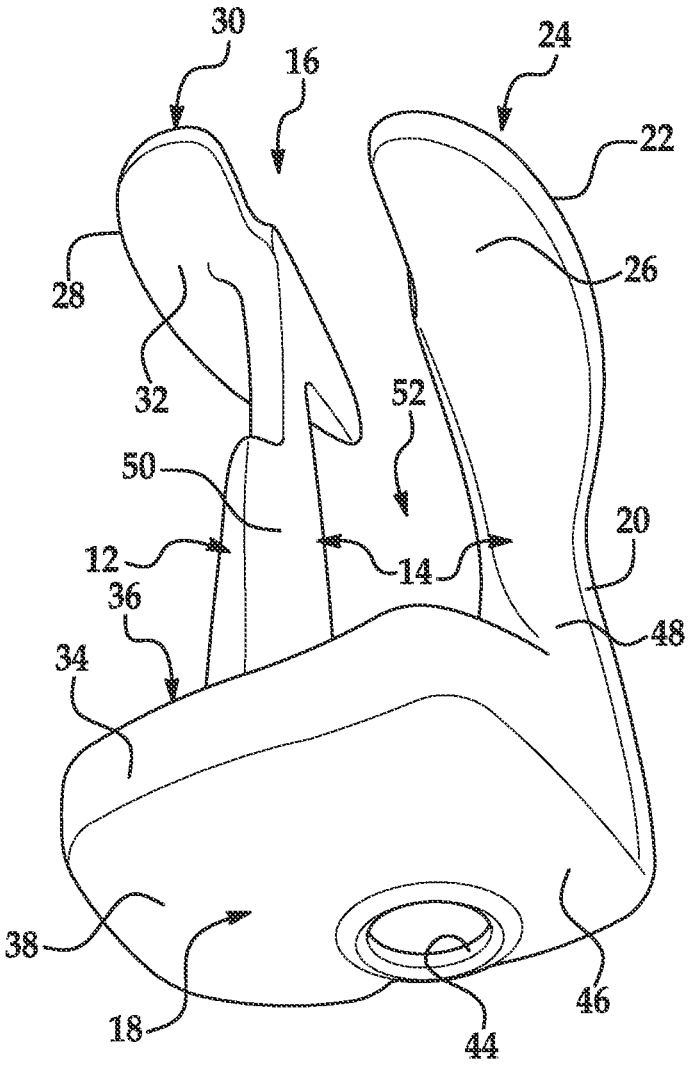
FIG. 4 is a perspective view of a bottom end of an ergonomic handle assembly of FIGS. 1-3 including a base portion and longitudinally extending side portions.
Figure 5A:
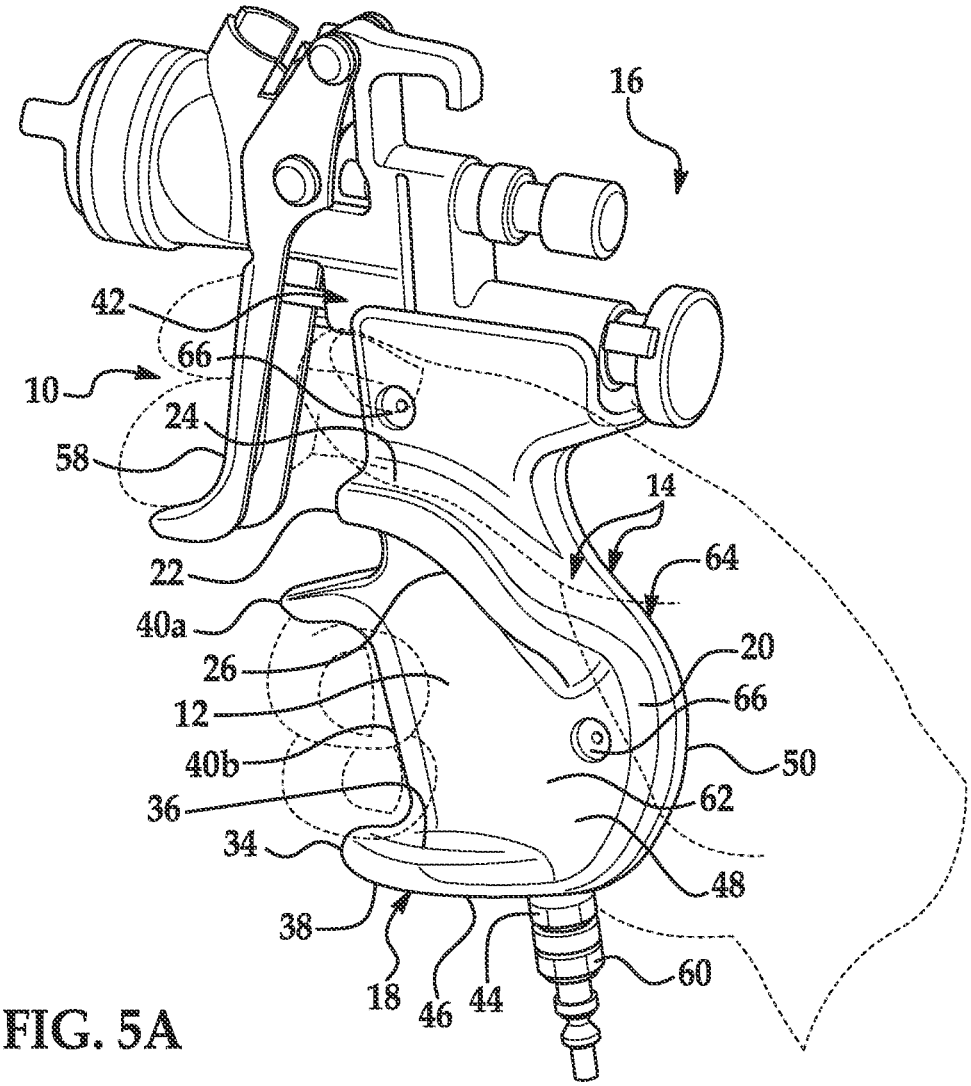
FIG. 5A-5D are views of an ergonomic handle assembly including separate halves to be assembled together.
Figure 5B:
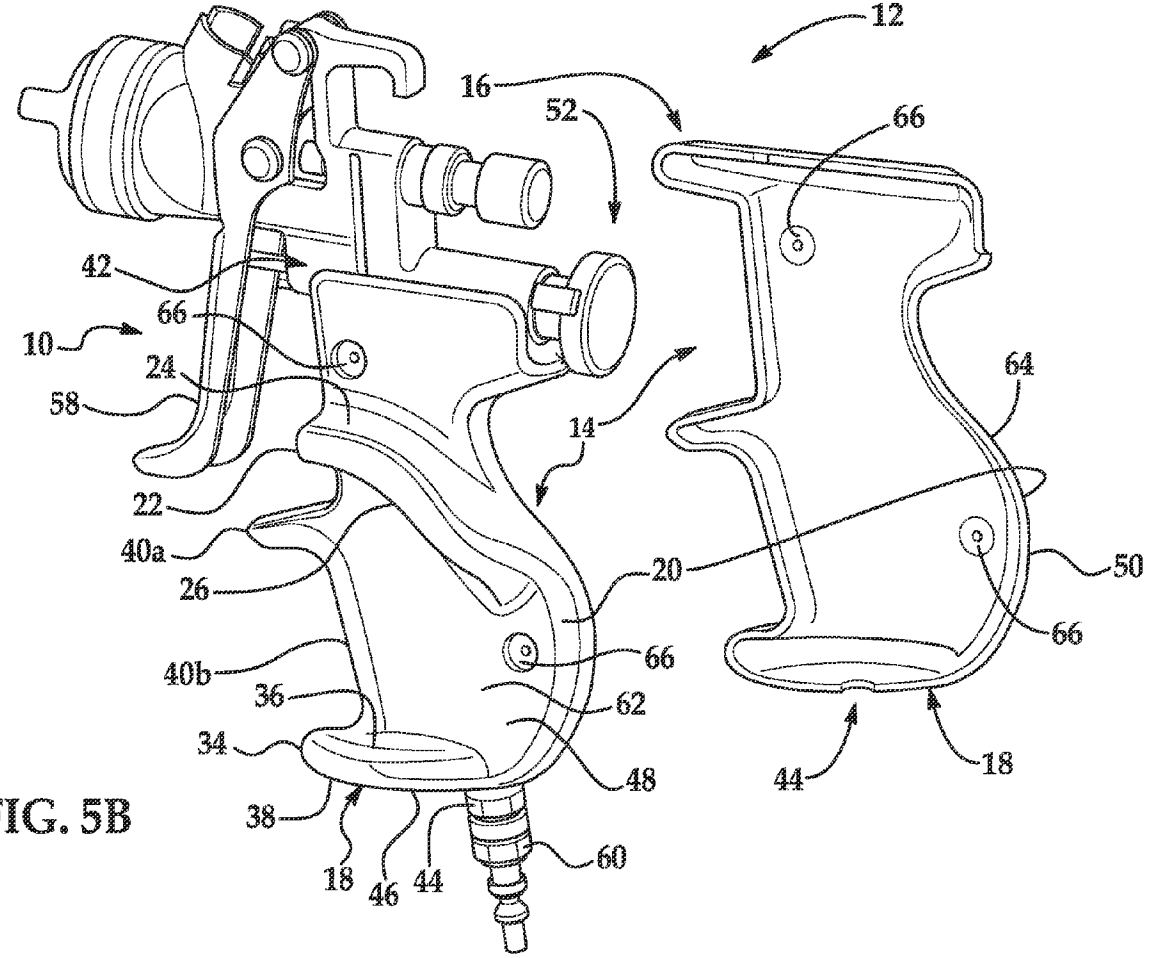
Figure 5C:
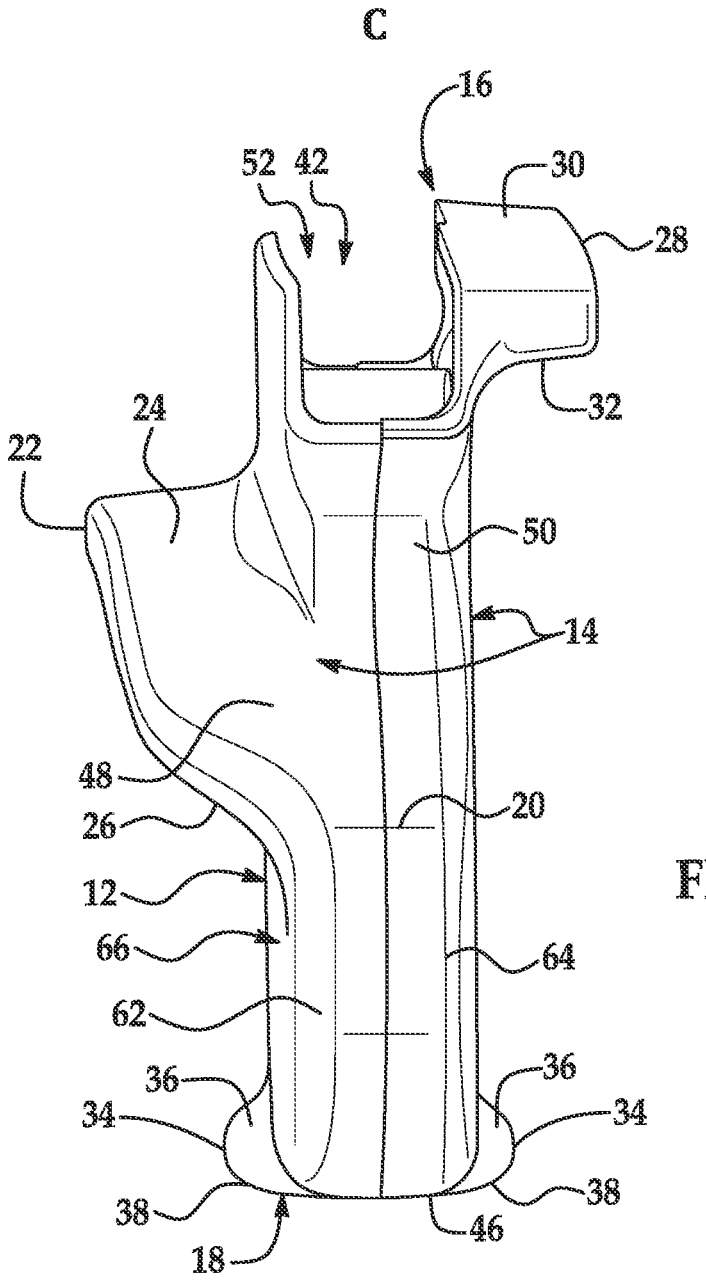
Figure 5D:
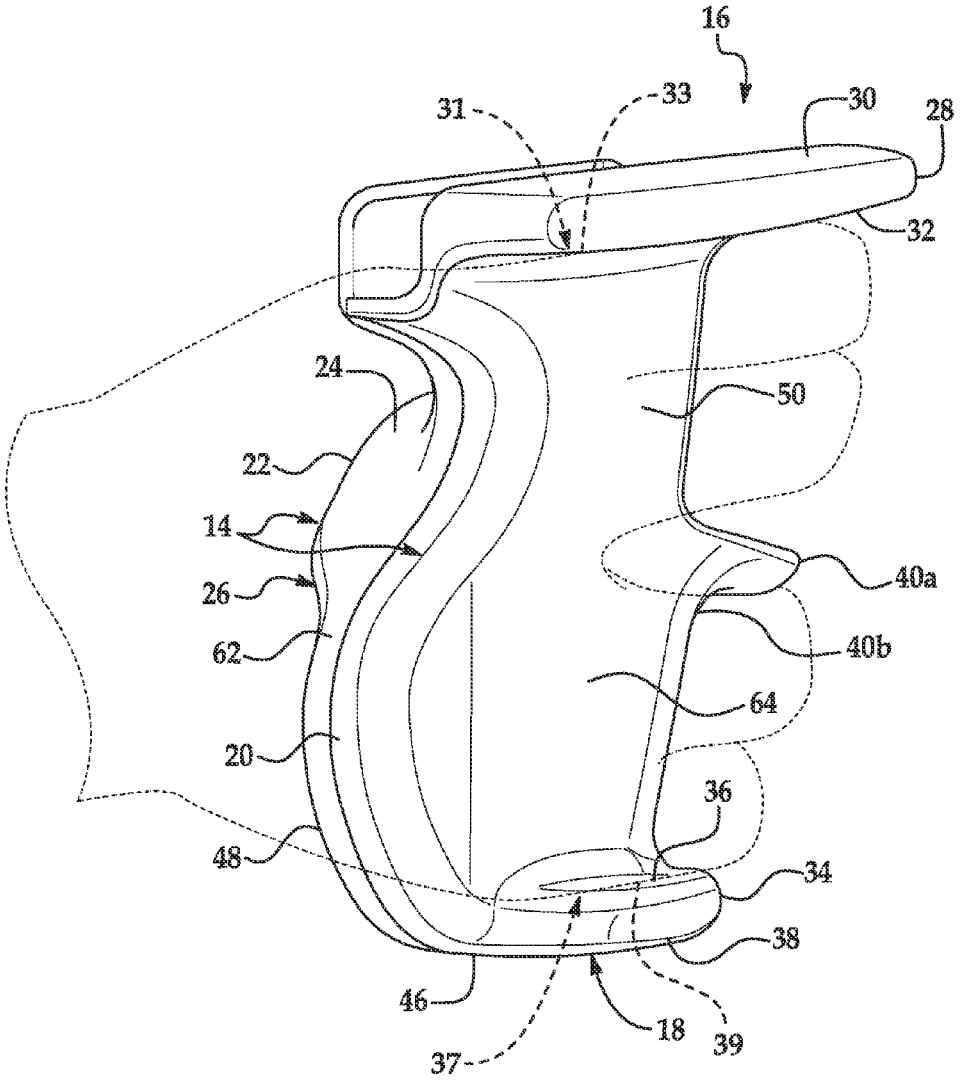
Figure 6:
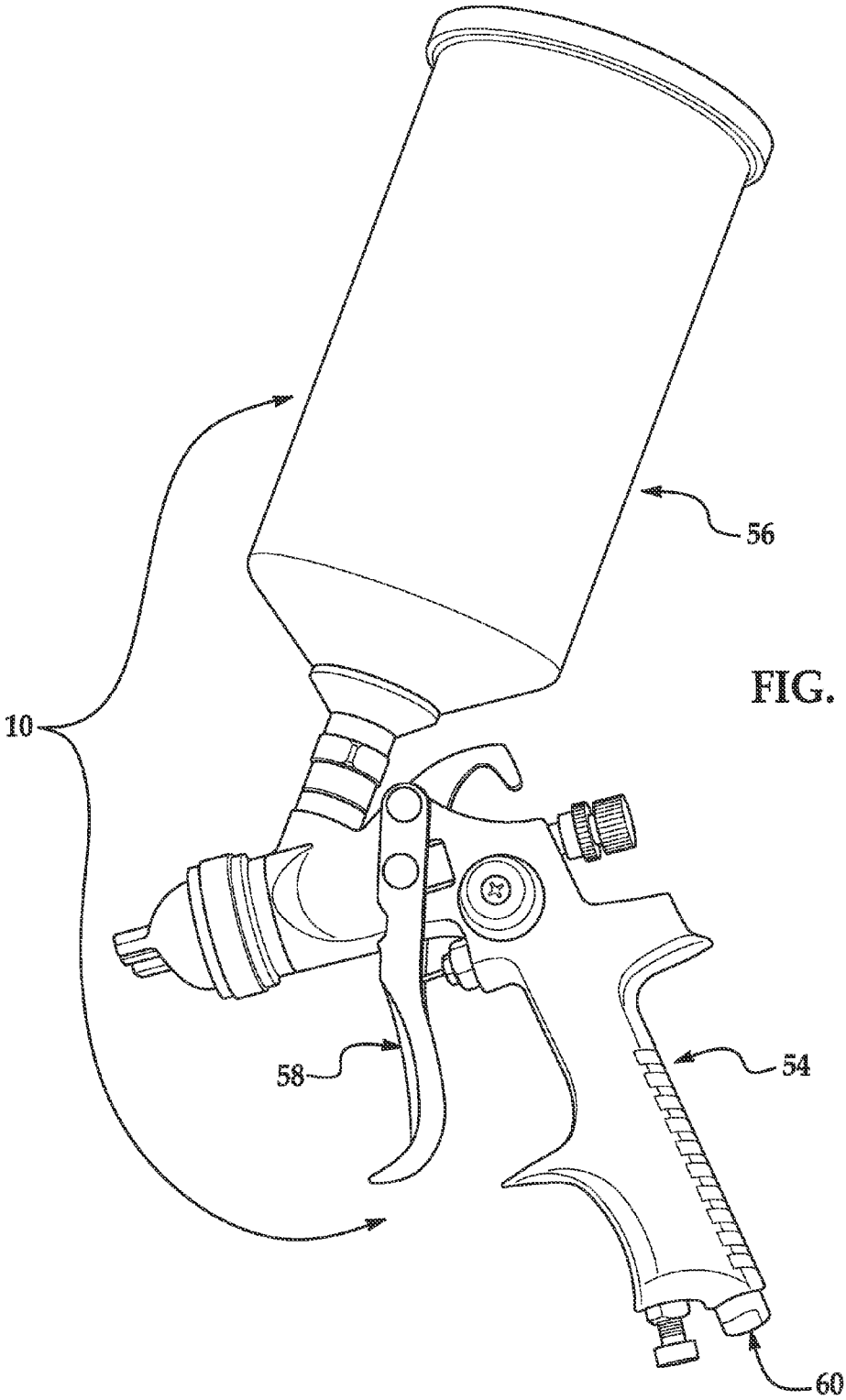
FIG. 6 is a side elevational view of a typical known spray gun including a handle assembly.

Referring now to FIG. 1, an ergonomic handle 12 can have an elongated body 14 with a proximal end 16 and a distal end 18 with respect to a discharge nozzle of a fluid applicator spray gun assembly 10 (as best seen in FIG. 6). The elongated body 14 can extend from the fluid applicator spray gun assembly 10 and can allow an operator of the fluid applicator spray gun to grip the ergonomic handle 12 via an external contoured and convex surface 20. The elongated body 14 can include at least one protruding tab 40*a* defining at least one groove 40*b* to accommodate one or more fingers of an operator. On the distal end 18 of the elongated body 14, a port 44 can allow a coupling for a hose supplying compressed air to extend through the port 44 as best seen in FIG. 2. It should be recognized that the ergonomic handle 12 can be formed as a single monolithic elongated body 14 as seen in FIGS. 1-4, or can be assembled into an elongated body 14 from one or more parts as illustrated in FIGS. 5A-5D.

A first support shoulder 22 can extend transversely from the elongated body 14 and can be located nearer to the proximal end 16 of the elongated body 14 than the distal end 18. The first support shoulder 22 can have a proximal transverse surface 24 and a distal transverse surface 26. The first support shoulder 22 can accommodate and provide a support surface with respect to a thumb of an operator on the proximal transverse surface 24. As shown in FIG. 2, the proximal transverse surface 24 of the first support shoulder 22 can be sized to completely support a thumb of the operator. A thumb of an operator can be placed on the proximal transverse surface 24 of the first support shoulder 22 in order to provide the operator with greater control of the spray gun 10 and deter or prevent tipping of the spray gun 10 toward the operator. As shown in FIG. 4, the proximal transverse surface 24 of the first support shoulder 22 may project substantially perpendicular to a central axis C of the elongated body 14.

Figure 3:
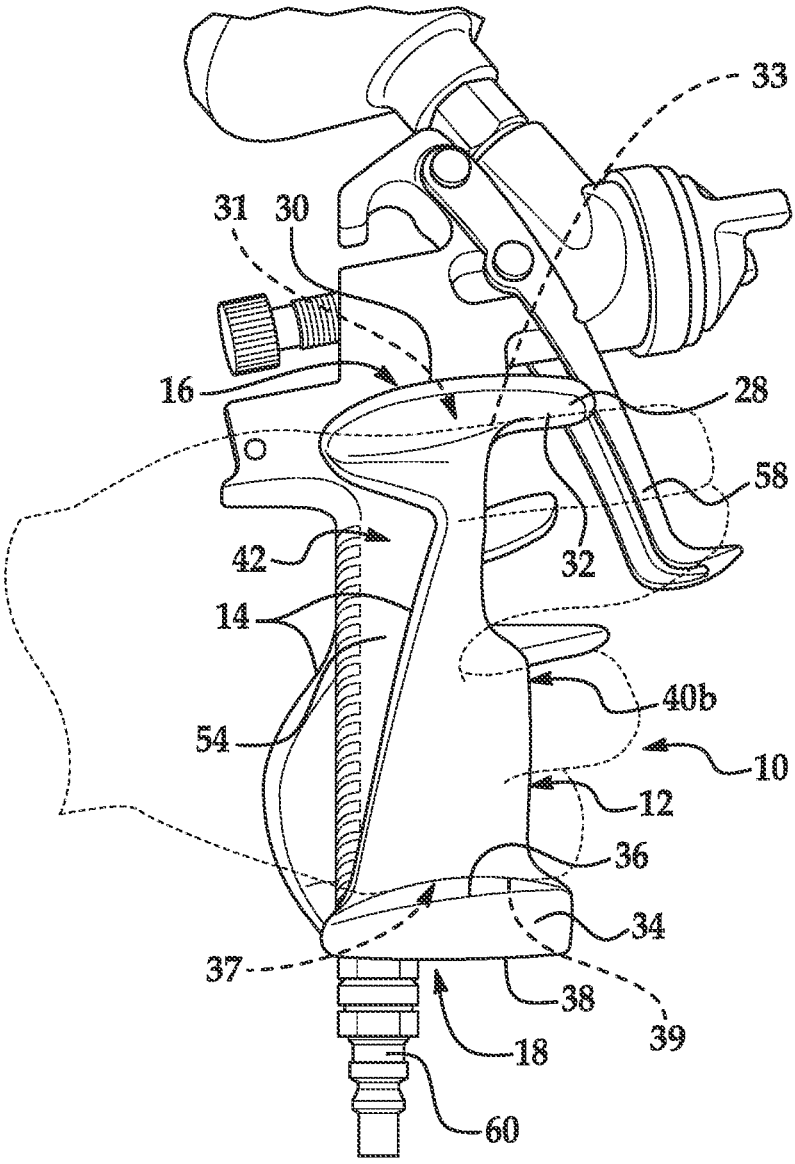
FIG. 3 is a side elevational view of a second side of an ergonomic handle assembly of FIGS. 1-2.

A second support shoulder 28 can extend laterally from the elongated body 14 and can be located on an opposite side with respect to the first support shoulder 22 in a position closer to the proximal end 16 of the elongated body 14 than the first support shoulder 22. The second support shoulder 28 can have a proximal lateral surface 30 and a distal lateral surface 32. The second support shoulder 28 can accommodate and provide a support surface with respect to an index finger of an operator on the distal lateral surface 32. As shown in FIG. 3, the distal lateral surface 32 of the second support shoulder 28 can be sized to accommodate a substantial second portion 31 of an upper index finger surface 33 of the operator. The second support shoulder 28 can allow an operator to better distribute the weight of the spray gun assembly 10 to deter or prevent tipping of the spray gun 10 away from the operator. As shown in FIG. 4, the distal lateral surface 32 of the second support shoulder 28 may project substantially perpendicular to the central axis C of the elongated body 14.

A third support shoulder 34 can extend laterally from the elongated body 14. The third support shoulder 34 can be located nearer to the distal end 18 of the elongated body 14 than the proximal end 16 and can be oriented on the same side of the elongated body 14 as the second support shoulder 22. The third support shoulder 34 can have a proximal surface 36 and a distal surface 38. The proximal surface 36 on the third support shoulder 34 can accommodate and provide a support surface with respect to a pinky finger of an operator. As shown in FIG. 3, the proximal surface 36 of the third support shoulder 34 can be sized to accommodate a substantial third portion 37 of a lower pinky finger surface 39 of the operator. The third support shoulder 34 can allow an operator to support additional weight of the fluid applicator spray gun 10 and deter or prevent the spray gun 10 from tipping toward the operator. As shown in FIG. 4, the proximal surface 36 of the third support shoulder 34 may project substantially perpendicular to the central axis C of the elongated body 14.

Referring now to FIG. 2, there is shown a side view of a first side of an ergonomic fluid applicator sprayer handle 12. A central aperture 42 can extend from the distal end 18 to the proximal end 16 of the elongated body 14. The central aperture 42 can be shaped in a way to accommodate an existing handle 54 of the fluid applicator spray gun 10 as best seen in FIG. 6. The first support shoulder 22 with the proximal transverse surface 24 and distal transverse surface 26 are in close proximity to a trigger mechanism 58 of the spray gun 10. This configuration can allow an operator to maintain control over the spray gun 10 while engaging the trigger mechanism 58. The port 44 can be located at the distal end 18 of the elongated body 14 with an air hose coupling 60 installed connected to the spray gun 10 and extending outwardly through the port 44. The external convex surface 20 of the elongated body 14 can provide a contour with curvature to conform to a palm of a hand of an operator to offer more support when the fluid applicator spray gun 10 is in use. In providing a contour with curvature to conform to the palm of a hand, an after market configuration of the elongated body 14 can either substantially sheath, or partially sheath, an existing hand grip of the fluid applicator spray gun 10 as best seen in FIG. 2. It should be recognized that the contour with curvature conforming to the palm of hand as illustrated and described herein can also be manufactured as an integral part of the handle of the fluid applicator spray gun 10 by an original equipment manufacturer without departing from the spirit and scope of the appended claims.

Referring now to FIG. 3, there is shown a side view of a second side of an ergonomic fluid applicator sprayer handle 12 opposite from the first side. A central aperture 42 can extend from the distal end 18 to the proximal end 16 of the elongated body 14. The second support shoulder 28 can be located nearer to the proximal end 16 of the elongated body 14. The second support shoulder 22 can have a proximal lateral surface 30 and a distal lateral surface 32 where the distal surface 32 can accommodate an index finger of an operator. The second support shoulder 22 can provide an area of support with respect to the index finger of an operator while still allowing the operator to activate the trigger 58. The third support shoulder 34 can have a proximal surface 36 and a distal surface 38 located nearer to the distal end 18 of the elongated body 14 than the proximal end 16. The proximal surface 36 of the third support shoulder 34 can accommodate and provide a support surface engaging with respect to a pinky finger of an operator and allows for a reduction in stress placed on a hand and arm of an operator using the fluid applicator spray gun 10. The port 44 can be located at the distal end of the elongated body with an air hose coupling 60 installed and extending through the port 44. The external convex surface 20 of the elongated body 14 can provide a contour with curvature to conform to a palm of a hand of an operator to offer more support when the fluid applicator spray gun 10 is in use.

Referring now to FIG. 4, a perspective view of a single monolithic unitary elongated body 14 to be assembled over an existing fluid applicator sprayer handle for retrofitting an existing fluid applicator spray gun to a more ergonomic configuration. The ergonomic handle 12 can be formed as a removable overlay with a base portion 46 formed at a distal end 18 of the ergonomic handle overlay. A first longitudinally extending side portion 48 and a second longitudinally extending side portion 50 extend outwardly from the base portion 46 and engage on opposite sides of the existing fluid applicator spray gun handle as best seen in FIG. 2. The first and second longitudinally extending side portions 48, 50 and base portion 46 can define the elongated body 14 of the ergonomic handle and can form an external contoured convex surface 20 for an operator to grip. The elongated body 14 can include at least one protruding tab 40*a* defining at least one groove 40*b* for accommodating and providing support for one or more fingers of an operator. The termination point of the longitudinally extending side portions 48, 50 can form a proximal end 16 of the elongated body 14. An internal aperture 52 can be defined between the first and second side portions 48, 50 to conform to an external surface of an existing handle of a fluid applicator spray gun. A port 44 can be provided on the distal end 18 of the elongated body 14 and can allow a coupling for an air-hose to extend through the port 44.

A first support shoulder 22 can extend transversely outward from the first longitudinally extending side portion 48 and can be located nearer to the proximal end 16 of the elongated body 14 than the distal end 18. The first support shoulder 22 can have a proximal transverse surface 24 and a distal transverse surface 26. The first support shoulder 22 can accommodate and provide a support surface with respect to a thumb finger of an operator on the proximal transverse surface 24. As shown in FIG. 2, the proximal transverse surface 24 of the first support shoulder 22 can be sized to completely support a thumb of the operator. A thumb of an operator can be placed on the proximal transverse surface 24 of the first support shoulder 22 in order to provide an operator with greater control of the spray gun 10 and to deter or prevent tipping of the spray gun 10 toward the operator. As shown in FIG. 4, the proximal transverse surface 24 of the first support shoulder 22 may project substantially perpendicular to the central axis C of the elongated body 14.

A second support shoulder 28 can extend laterally outward from the second longitudinally extending side portion 50. The second support shoulder 28 can have a proximal lateral surface 30 and a distal lateral surface 32 and can be located on an opposite side of the handle with respect to the first support shoulder 22 in a position closer to the proximal end 16 of the elongated body 14 than the first support shoulder 22. The second support shoulder 28 can accommodate and provide a support surface with respect to an index finger of an operator on the distal lateral surface 32. As shown in FIG. 3, the distal lateral surface 32 of the second support shoulder 28 can be sized to accommodate a substantial second portion 31 of an upper index finger surface 33 of the operator. The second support shoulder 28 can improve distribution of the weight of the sprayer assembly over a larger surface area of a hand of an operator and can assist to deter or prevent the tipping of the fluid applicator spray gun assembly away from the operator. As shown in FIG. 4, the distal lateral surface 32 of the second support shoulder 28 may project substantially perpendicular to the central axis C of the elongated body 14.

A third support shoulder 34 can extend laterally outward from the second longitudinally extending side portion 50. The third support shoulder 34 can be located nearer to the distal end 18 of the elongated body 14 than the proximal end 16 and can be oriented on the same side of the elongated body 14 as the second support shoulder 28. The third support shoulder 34 can have a proximal surface 36 and a distal surface 38. The proximal surface 36 of the third support shoulder 34 can accommodate and provide a support surface with respect to a pinky finger of an operator. As shown in FIG. 3, the proximal surface 36 of the third support shoulder 34 can be sized to accommodate a substantial third portion 37 of a lower pinky finger surface 39 of the operator. The third support shoulder 34 can provide additional support for distribution of the weight of the fluid applicator sprayer over a greater area in three dimensions with respect to a hand of an operator and can help deter or prevent a fluid applicator spray gun from tipping toward the operator. As shown in FIG. 4, the proximal surface 36 of the third support shoulder 34 may project substantially perpendicular to the central axis C of the elongated body 14.

It should be recognized that a combination of any of the first, second and third shoulders 22, 28, 32 can provide increased support surface area in three dimensions with respect to a hand of an operator supporting the fluid applicator spray gun 10 by distributing weight across both the palm and fingers through the proximal support surface of the first support shoulder 22, the distal support surface of the second support shoulder 28, and the proximal support surface of the third support shoulder 34. The increased support surface area can allow an operator to support and handle the fluid applicator spray gun 10 with reduced gripping force when compared to existing fluid applicator spray guns. The reduced gripping force required by the ergonomic handle to support and use the fluid applicator spray gun 10 can reduce the likelihood of repetitive stress syndrome injuries to the hand and arm of an operator.

Referring now to FIGS. 5A-5D, there are shown views of an ergonomic handle 14 split into a first part 62 and a second part 64. When combined, the first and second parts 62, 64 can form an assembled ergonomic handle 12. The first and second parts 62, 64 can be assembled together to form a base portion 46 of the ergonomic handle 12 at a distal end 18. The first and second parts 62, 64 can be connected with respect to an existing handle 54 of a fluid applicator spray gun 10 with at least one fastener 66. As illustrated in FIGS. 5A-5D, the ergonomic handle 12 can be assembled to and can be removable from an existing spray gun handle. A first longitudinally extending side portion 48 and a second longitudinally extending side portion 50 can project outwardly from the base portion 46 of each of the first and second parts 62, 64. The longitudinally extending side portion 48 can extend outwardly from the first part 62 and the longitudinally extending side portion 50 can extend outwardly from the second part 64. The first and second longitudinally extending side portions 48, 50 can define the elongated body 14 of the ergonomic handle 12 and can define an external contoured convex surface 20 for an operator to grip the handle 12. A termination point of the first and second longitudinally extending side portions 48, 50 can define a proximal end 16 of the handle 12. An internal aperture 52 can be located between the first and second side portions 48, 50 and can conform to an external surface of an existing handle of a fluid applicator spray gun 10.

A first support shoulder 22 can extend transversely outwardly from the first longitudinally extending side portion 48 and can be located nearer to the proximal end 16 of the elongated body 14 than the distal end 18. The first support shoulder 22 can have a proximal transverse surface 24 and a distal transverse surface 26. A thumb of an operator can be placed on the proximal transverse surface 24 of the first support shoulder 22 in order to provide the operator with greater control of the spray gun 10 and to deter or prevent tipping of the spray gun 10 toward the operator. As shown in FIG. 5A, the proximal transverse surface 24 of the first support shoulder 22 can be sized to completely support a thumb of the operator. As shown in FIG. 5C, the proximal transverse surface 24 of the first support shoulder 22 may project substantially perpendicular to the central axis C of the elongated body 14.

A second support shoulder 28 can extend laterally outwardly from the second longitudinally extending side portion 50. The second support shoulder 28 can have a proximal lateral surface 30 and a distal lateral surface 32 and can be located on an opposite side of the handle 12 with respect to the first support shoulder. The second support shoulder 28 can be in a position closer to the proximal end 16 of the elongated body 14 than the first support shoulder 22. The second support shoulder 28 can accommodate and provide a support surface with respect to an index finger of an operator the distal lateral surface. As shown in FIG. 5D, the distal lateral surface 32 of the second support shoulder 28 can be sized to accommodate a substantial second portion 31 of an upper index finger surface 33 of the operator. The second support shoulder 28 can allow an operator to better distribute the weight of the sprayer assembly and prevent the tipping of the assembly away from the operator. As shown in FIG. 5C, the distal lateral surface 32 of the second support shoulder 28 may project substantially perpendicular to the central axis C of the elongated body 14.

A third support shoulder 34 can extend laterally from the second longitudinally extending side portion. The third support shoulder 34 can be located nearer to the distal end of the elongated body and can be oriented on the same side of the elongated body as the second support shoulder. The third support shoulder 34 can have a proximal surface 36 and a distal surface 38. The proximal surface 36 defined on the third support shoulder 34 can accommodates the pinky finger of the operator. As shown in FIG. 5D, the proximal surface 36 of the third support shoulder 34 can be sized to accommodate a substantial third portion 37 of a lower pinky finger surface 39 of the operator. The third support shoulder 34 can allow for the operator to have additional support of the weight of the fluid applicator sprayer and prevent the sprayer from tipping towards the operator. As shown in FIG. 5C, the proximal surface 36 of the third support shoulder 34 may project substantially perpendicular to the central axis C of the elongated body 14. The elongated body 14 can include at least one protruding tab 40*a* defining at least one groove 40*b* to accommodate at least one finger of the operator formed on at least one of the first and second longitudinally extending side portions. On the distal end of the elongated body 14, a port 44 can be provided to allow for the coupling of an air-hose to extend through.

Referring now to FIG. 6, a known fluid applicator sprayer device 10 is illustrated. The sprayer 10 can have an existing handle 54 with a sprayer trigger 58 orientated so that an operator can engage the trigger while holding the handle. The fluid reservoir 56 is illustrated as being located above the existing handle and can be filled with fluid material, by way of example and not limitation such as a paint material, during use. It should be recognized that the reservoir can be located in other positions depending on the type and style of spray gun. By way of example and not limitation, the reservoir can be located below the spray nozzle and inline with the handle in known configurations. An air-hose coupling 60 can be located at the base of the existing handle.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An ergonomic handle for a fluid applicator sprayer to be held in a hand of an operator, the ergonomic handle comprising:

an elongated body having a base portion forming a distal end of the handle, the elongated body extending from the distal end and terminating at a topmost point forming a proximal end of the handle;

the elongated body including a contoured and convex external surface conforming to the hand of the operator;

the elongated body having a first support shoulder with a proximal transverse surface and a distal transverse surface projecting transversely from the elongated body and located nearer to the proximal end of the elongated body than the distal end;

the proximal transverse surface of the first support shoulder sized to completely support a thumb of the operator and projecting at or near perpendicular to a central axis of the elongated body;

a second support shoulder with a proximal lateral surface and a distal lateral surface projecting laterally from the elongated body and located nearer to the proximal end of the elongated body than the distal end, the second support shoulder located in an orientation opposite the first support shoulder, the second support shoulder located closer to the proximal end of the elongated body than the first support shoulder; and the distal lateral surface of the second support shoulder sized to accommodate a substantial second portion of an upper index finger surface of the operator and projecting at or near perpendicular to the central axis of the elongated body.

2. The ergonomic handle of claim 1, wherein the elongated body further comprises:

a third support shoulder with a proximal surface and a distal surface projecting laterally from a position on the elongated body nearer to the distal end than the proximal end; and the proximal surface of the third support shoulder sized to accommodate a substantial third portion of a lower pinky finger surface of the operator and projecting at or near perpendicular to the central axis of the elongated body.

3. The ergonomic handle of claim 1, wherein the elongated body further comprises:

a third support shoulder with a proximal surface and a distal surface projecting radially outwardly from a position on the elongated body nearer to the distal end than the proximal end; and the proximal surface of the third support shoulder sized to accommodate a substantial third portion of a lower pinky finger surface of the operator and projecting at or near perpendicular to the central axis of the elongated body.

4. The ergonomic handle of claim 1, wherein the elongated body further comprises:

at least one protruding tab defining at least one groove to accommodate at least one finger of the operator.

5. The ergonomic handle of claim 4, wherein the elongated body defines a central aperture extending between the proximal end and the distal end, the central aperture shaped to accept an existing handle structure of a fluid applicator sprayer.

6. The ergonomic handle of claim 1, wherein the elongated body defines a central aperture extending between the proximal end and the distal end, the central aperture shaped to accept an existing handle structure of a fluid applicator sprayer.

7. The ergonomic handle of claim 6, wherein the elongated body further comprises: the distal end of the handle defining a port allowing an air-hose coupling to be connected therethrough.

8. The ergonomic handle of claim 1, wherein the elongated body is formed of a hard molded polymer material.

9. The ergonomic handle of claim 1, wherein the elongated body is formed of a hard metal material.

10. In a fluid applicator sprayer having a handle to be held in a hand of an operator, the improvement of an ergonomic handle comprising:

a removable overlay elongated body attachable to the handle of the fluid applicator sprayer, the removable overlay elongated body having a base portion forming a distal end of the handle, a first longitudinally extending side portion and a second longitudinally extending side portion extending from the base portion, a termination point of the longitudinally extending side portions forming a proximal end of the handle, the handle defining an internal aperture located between the side portions conforming to an external surface of the handle of the fluid applicator sprayer, the side portions having an external convex gripping surface contoured to conform with the hand of the operator, and the base portion defining a port allowing an air-hose coupling to extend therethrough;

the removable overlay elongated body having a first support shoulder with a proximal transverse surface and a distal transverse surface projecting transversely from the first longitudinal extending side portion nearer to the proximal end of the handle than the distal end;

the proximal transverse surface of the first support shoulder sized to completely support a thumb of the operator and projecting at or near perpendicular to a central axis of the removable overlay elongated body;

a second support shoulder with a proximal lateral surface and a distal lateral surface projecting laterally from the second longitudinally extending side portion nearer to the proximal end of the handle than the distal end, the second support shoulder located closer to the proximal end of the handle than the first support shoulder; and the distal lateral surface of the second support shoulder sized to accommodate a substantial second portion of an upper index finger surface of the operator and projecting at or near perpendicular to the central axis of the removable overlay elongated body.

11. The ergonomic handle of claim 10, wherein the removable overlay elongated body further comprises:

a first half body portion and a second half body portion defining the base portion and the first and second longitudinally extending side portions, the first and second half body portions engageable with one another to enclose a substantial portion of the handle of the fluid applicator sprayer.

12. The ergonomic handle of claim 11, wherein the removable overlay elongated body further comprises:

at least one fastener securing the first half body portion and the second half body portion of the removable overlay elongated body with respect to the fluid applicator sprayer.

13. The ergonomic handle of claim 10, wherein the removable overlay elongated body further comprises:

a third support shoulder with a proximal surface and a distal surface projecting radially outwardly from the second longitudinally extending side portion nearer to the distal end of the handle than the proximal end; and the proximal surface of the third support shoulder sized to accommodate a substantial third portion of a lower pinky finger surface of the operator and projecting at or near perpendicular to the central axis of the removable overlay elongated body.

14. The ergonomic handle of claim 13, wherein the removable overlay elongated body further comprises:

at least one protruding tab defining at least one groove to accommodate at least one finger of the operator formed on at least one of the first and second longitudinally extending side portions.

15. An ergonomic handle for a fluid applicator sprayer to be held in a hand of an operator, the ergonomic handle comprising:

a removable overlay elongated body attachable to a handle of the fluid applicator sprayer, the removable overlay elongated body including a base portion forming a distal end of the handle, the base portion including a port allowing an airhose coupling to extend therethrough, a first longitudinally extending side portion and a second longitudinally extending side portion extending from the distal end, a termination point of the longitudinally extending side portions forming a proximal end of the handle, the removable overlay elongated body defining an internal aperture located between the first and second longitudinally extending side portions conforming to an external surface of the handle of the fluid applicator sprayer, the first and second longitudinally extending side portions having external convex gripping surfaces contoured to conform with the hand of the operator;

a first support shoulder with a proximal transverse surface and a distal transverse surface projecting transversely from the first longitudinally extending side portion nearer to the proximal end of the handle, the proximal transverse surface of the first support shoulder sized to completely support a thumb of the operator and projecting at or near perpendicular to a central axis of the removable overlay elongated body;

a second support shoulder with a proximal lateral surface and a distal lateral surface projecting laterally from the second longitudinally extending side portion nearer to the proximal end of the handle, the second support shoulder located closer to the proximal end of the handle than the first support shoulder, the distal lateral surface of the second support shoulder sized to accommodate a substantial second portion of an upper index finger surface of the operator and projecting at or near perpendicular to the central axis of the removable overlay elongated body; and a third support shoulder with a proximal surface and a distal surface projecting radially outwardly from the second longitudinally extending side portion nearer to the distal end of the handle, the proximal surface of the third support shoulder sized to accommodate a substantial third portion of a lower pinky finger surface of the operator and projecting at or near perpendicular to the central axis of the removable overlay elongated body.

16. The ergonomic handle of claim 15, wherein the base and the first and second longitudinally extending side portions further comprise:

a first half body portion and a second half body portion connectable with respect to the handle of the fluid applicator sprayer with at least one fastener.

* * * * *